US010756470B2

(12) United States Patent
Bally et al.

(10) Patent No.: US 10,756,470 B2
(45) Date of Patent: Aug. 25, 2020

(54) CONNECTING ELEMENT, HOUSEHOLD APPLIANCE HAVING SUCH A CONNECTING ELEMENT, AND INSERT MODULE

(75) Inventors: Ingo Bally, Traunstein (DE); Peter Blumenthal, Traunstein (DE); Alexander Dinkel, Unterwoessen (DE); Klemens Roch, Trostberg (DE)

(73) Assignee: BSH Hausgeräte GmbH, Munich (DE)

( * ) Notice: Subject to any disclaimer, the term of this patent is extended or adjusted under 35 U.S.C. 154(b) by 1233 days.

(21) Appl. No.: 13/990,159

(22) PCT Filed: Dec. 7, 2011

(86) PCT No.: PCT/EP2011/071990

§ 371 (c)(1),
(2), (4) Date: May 29, 2013

(87) PCT Pub. No.: WO2012/080047

PCT Pub. Date: Jun. 21, 2012

(65) Prior Publication Data

US 2013/0260618 A1 Oct. 3, 2013

(30) Foreign Application Priority Data

Dec. 17, 2010 (DE) ..... 10 2010 063 464

(51) Int. Cl.
*H01R 13/17* (2006.01)
*H01R 33/18* (2006.01)
*F24C 15/16* (2006.01)

(52) U.S. Cl.
CPC ..... *H01R 13/17* (2013.01); *F24C 15/166* (2013.01); *H01R 33/18* (2013.01)

(58) Field of Classification Search
CPC ..... F24C 15/166; F24C 7/06; F24C 15/00; H01R 13/17; H01R 13/7036;
(Continued)

(56) References Cited

U.S. PATENT DOCUMENTS 2,516,503 A * 7/1950 Bock ..... F24C 7/02 200/85 R
3,416,125 A * 12/1968 Theve ..... H01R 24/52 439/638

(Continued)

FOREIGN PATENT DOCUMENTS

DE 1515217 A1 11/1969
DE 10261733 A1 7/2004

(Continued)

OTHER PUBLICATIONS

International Search Report PCT/EP2011/071990 dated Mar. 30, 2012.

*Primary Examiner* — Michael G Hoang
(74) *Attorney, Agent, or Firm* — Michael E. Tschupp; Andre Pallapies; Brandon G. Braun

(57) ABSTRACT

A connecting element for providing an electrical connection in a processing space of a household appliance, includes a protruding, longitudinally displaceable contact pin configured for displacement between a rest position protruding farther and an operating position protruding less far, wherein the contact pin pushes into the rest position. The connecting element is disposed on a side wall of the processing space, particularly a cooking space. An insert module can be inserted in the processing space of the household appliance and can be operated electrically. The insert module has a mating electrical connection element for contacting the connecting element.

36 Claims, 2 Drawing Sheets

(58) Field of Classification Search
CPC ..... H01R 13/2421; H01R 33/18; H01R 13/2464; H01R 13/2471; H01R 13/2478; H01R 13/24; H01R 13/20; H01R 13/04; H01R 13/10; H01R 13/15; A47J 37/01
USPC ..... 219/391, 392, 395, 398, 403; 439/289–295, 500, 515, 638, 700, 824; 362/94
See application file for complete search history.

(56) References Cited

U.S. PATENT DOCUMENTS 3,659,063 A 4/1972 Peterson
3,676,626 A * 7/1972 Mitchell ..... H01H 13/14 200/302.2
4,734,051 A * 3/1988 Burns ..... H01R 13/7036 439/289
5,067,906 A * 11/1991 Woodgate ..... F21V 21/12 439/115
5,543,784 A * 8/1996 Mendenhall ..... F24C 15/16 200/85 R
5,992,411 A * 11/1999 Ayot ..... A47B 31/02 126/246
6,951,489 B2 * 10/2005 Sekiguchi ..... H01R 13/2421 439/700
7,717,756 B1 * 5/2010 Yin ..... H01R 13/2421 439/700
2004/0077219 A1 4/2004 Wen-Yao
2004/0155023 A1 8/2004 Wermbter et al.
2004/0221742 A1 * 11/2004 Park ..... A21B 7/005 99/348
2005/0037651 A1 2/2005 Axenbock et al.
2007/0103887 A1 * 5/2007 Bleier ..... H01H 13/18 362/92
2007/0181410 A1 * 8/2007 Baier ..... F24C 7/082 200/17 R
2009/0230116 A1 * 9/2009 Hsu ..... A47J 36/02 219/439
2010/0020507 A1 * 1/2010 Pianezze ..... F23Q 3/00 361/728
2012/0085745 A1 * 4/2012 Brattoli ..... A47B 31/02 219/386

FOREIGN PATENT DOCUMENTS

DE 202005009818 U1 * 9/2005 ..... H01R 13/2421
DE 102009002864 A1 11/2010
EP 0498056 A1 8/1992
EP 1460342 A1 9/2004
EP 1676507 A2 7/2006
KR 20050114159 A * 12/2005
WO 0003458 A1 1/2000

* cited by examiner

CONNECTING ELEMENT, HOUSEHOLD APPLIANCE HAVING SUCH A CONNECTING ELEMENT, AND INSERT MODULE

BACKGROUND OF THE INVENTION

The invention relates to a connecting element for providing an electrical connection in a processing space of a household appliance, particularly a cooking appliance. The invention also relates to a household appliance, particularly a cooking appliance, with at least one such connecting element. The invention also relates to an electrically operable insert module for a processing space of a household appliance, it being possible for the insert module to have at least one mating electrical connection element.

Heated cooking space dividers and heated pizza stones with comparatively large plug-in connectors made of a ceramic-metal combination arranged on their rear sides are known. These plug-in connectors fit into electrical connections, in the form of sockets that are present in a rear wall of a cooking space of an oven. The sockets are comparatively difficult to clean, can negatively affect a circulating air system and do not give the appearance of high quality. The provision of a socket in a side wall of a cooking space for the manual connection of a meat thermometer is also known. Such a socket is also comparatively difficult to clean.

BRIEF SUMMARY OF THE INVENTION

The object of the present invention is to at least partially overcome the disadvantages of the prior art and, in particular, to provide an electrical connection in a processing space of a household appliance that is particularly easy to clean, only affects the operation of the household appliance slightly and has a high quality appearance.

The object is achieved by a connecting element for providing an electrical connection in a processing space of a household appliance, wherein the connecting element comprises a protruding, longitudinally displaceable contact pin that can be displaced between a rest position protruding farther (forward, or from a front side) and an operating position protruding less far, and wherein the contact pin pushes into the rest position. In other words, the contact pin can be at least partially inserted into the operating position from its rest position through the exertion of external force, with at least one component in the longitudinal direction of the contact pin. This enables, in particular, disposition of the connecting element on a side wall of the household appliance, which creates a better appearance. Also as a result, any circulating air system is no longer affected. This partial insertability improves both ease of cleaning and protection against mechanical stress, with robustness thus being improved. Such a connecting element can also easily be integrated into a household appliance.

The contact pin can, for the purposes of improved ease of cleaning and improved protection against mechanical stress, be fully insertable. The contact pin can be made in particular of metal and can, in particular, be spring mounted for pushing into the rest position.

In one embodiment, the connecting element comprises a first electrically insulating insulation sleeve in which the contact pin can be carried. This allows the contact pin to be positioned in an electrically safe and mechanically robust manner as well as centrally as regards its longitudinal axis.

To enable it to be carried in the first insulation sleeve the contact pin may comprise a laterally protruding, in particular annular, projection. While the contact pin protrudes on the front side, for example into the processing space, the first insulation sleeve may comprise an opening at the rear through which a rear end of the contact pin can be passed. The rear end preferably comprises a connection possibility for connecting a power supply cable or similar.

In another embodiment, the connecting element comprises a second electrically insulating insulation sleeve that surrounds the contact pin and (in the longitudinal direction) is arranged in front of the first insulation sleeve. As a result, predefined creep and air paths can easily be adhered to, including in the operating position. The second insulation sleeve can, in particular, be provided in such a way that it protrudes into the processing space, in particular through a securing disc introduced from the processing space.

In another embodiment, the second insulation sleeve has a groove on its outer edge that is at least partially exposed. As a result it is possible, at least partially, to prevent any water that runs down a side wall of the processing space from running into the connecting element.

In a further embodiment, the connecting element comprises a housing that surrounds at least sections of the first insulation sleeve and the second insulation sleeve.

In a further embodiment, the connecting element comprises a housing, said housing having at least one, in particular two, lateral openings. The at least one lateral opening is, in particular, a downwardly directed opening. Water that has entered the connecting element can flow out through the at least one lateral opening.

In a further embodiment, the connecting element comprises a housing, said housing comprising at least one inwardly protruding projection that forms a stop for the contact pin in the rest position. This enables robust and precise setting of the rest position. In addition, if the housing is electrically conductive and grounded, it is then simple to ground the contact pin in the rest position, particularly if no insert module is used. For this embodiment, a two-part configuration of the electrical insulation of the contact pin incorporating the first insulation sleeve and the second insulation sleeve makes assembly particularly simple. Thus, both the first insulation sleeve and the second insulation sleeve, which are surrounded by the housing, can simply be pushed into opposite ends of the housing as far as the stop on the projection and then fixed. The housing can, in particular, be made of metal.

One development is then that, if the projection is not embodied so as to be circumferential, at least one lateral opening for the draining of water is located at the point between the first insulation sleeve and the second insulation sleeve where there is no projection.

In a further development, the projection is embodied so as to be circumferential, and at least one lateral opening for the draining of water (in a longitudinal direction) is located in front of and/or behind the projection. In this way, improved microwave tightness is achieved.

In a further development, the housing has a flange on its front edge that extends laterally outward, to provide support for and contact with a housing wall of the processing space or a muffle delimiting the processing space. As a result, it is possible for the connecting element to be secured in a stable manner. Also as a result, the contact pin can be grounded in the rest position in a particularly simple manner, using the housing as an electrically conducting intermediate element between the contact pin and the housing wall (e.g. of an oven muffle), which is normally grounded. In addition, it is possible for a microwave-tight connection to be produced by means of the flange together with the housing wall. In addition, it is possible for the flange and the housing wall together to produce a microwave-tight connection.

It is particularly advantageous as regards assuring the microwave tightness of the connecting element if a diameter of a front opening of the connecting element through which the contact pin extends forward is no greater then 8 mm. This opening is also microwave-tight, even without the contact pin.

The contact pin can have a bent tip at its front end. This enables high mechanical pressure to be exerted on a mating connection element that is to come into contact with the contact pin, thus enabling particularly good self-cleaning of the surface that comes into contact with the mating connection element. It is also possible, for example, for the contact pin to have a flat tip at its front end. This enables a large surface area to be produced on a mating connection element to come into contact with the contact pin.

The connecting element preferably complies with the relevant standard(s), e.g. VDE.

The object is also achieved by a household appliance, particularly a cooking appliance, with at least one connecting element for providing an electrical connection in a processing space of the household appliance, wherein the at least one connecting element comprises at least one connecting element as described above.

The household appliance can, in particular, be a cooking appliance, particularly an oven. The oven can, in particular, be a conventional oven, a microwave oven or a combined conventional/microwave oven.

In one embodiment, the household appliance has at least one such a connecting element on at least one insertion level on at least one side wall (of the processing space or of a housing wall, for example, a muffle delimiting the processing space) The advantage of this is that an improved appearance is produced. Also, any circulating air system is no longer affected. Furthermore, because the connecting element is arranged at the side, a mating connection element belonging to an insert module and fitting onto the connecting element can contact the connecting element in a sliding movement, as a result of which the contact surfaces of the connecting element and the mating connection element are automatically cleaned through abrasion (e.g. of a film of food or similar), thus providing particularly reliable contacting (self-cleaning of the contact surfaces). In other words, an insert module introduced into the processing appliance can contact the connecting element of the household appliance laterally with its at least one mating connection element, in particular by means of a sliding movement, for example, for electrically operating the insert module. For the purposes of contacting, part of the contact pin of the at least one connecting element is pushed part of the way into the housing by the mating connection element and presses against the mating connection element in the process.

The pressure force, in particular the spring force, of the contact pin here is preferably adjusted in such a way that both simple insertion or similar of the insert module and an optimal cleaning effect are achieved by the two connections sliding against one another.

The contact path is preferably also adjusted in such a way that the creep and air paths are adhered to, even when the insert module is unfavorably positioned.

In one development, each of the two side walls or lateral housing walls has at least one connecting element, with the connecting elements on the side walls, in particular, being arranged symmetrically to one another. This enables tilting to be particularly easily avoided.

In a further development, each insertion level of the household appliance is assigned at least one connecting element.

In another embodiment, the housing of the at least one connecting element is in contact with the side wall. It is then particularly simple to ground the housing and, where applicable, a contact pin contacting the housing in the rest position. A general development is then that the contact pin is grounded in the rest position.

The housing can, for example, be bolted together with, or onto, the housing wall, e.g. by means of a securing disc attached on its processing space side.

In a further embodiment, the housing forms a microwave-tight connection with the side wall. This, together with the microwave-tight embodiment of the connecting element itself, allows the household appliance to be operated in microwave mode.

In another embodiment, the household appliance comprises at least one insertion detection device, for detecting the presence of an insert module in the processing space. The insertion detection device can, for example, comprise a microswitch, a Reed contact or an optical sensor. This enables increased operating safety to be achieved.

In a further embodiment, the household appliance comprises a door closure detection device, to detect the closed state of a door that closes the processing space, and the household appliance is configured only to apply an electrical signal (e.g. a current) to the connecting element if the insertion detection device detects an insert and the door closure detection device detects a door closing the processing space, and/or a certain program is selected. In this way, even greater operating safety can be achieved.

The household appliance is preferably pyrolysis-safe.

The object is also achieved by an insert module for positioning in a processing space of a household appliance, it being possible for the insert to be operated electrically, and wherein the insert module has at least one mating electrical connection element at the side, for contacting a connecting element in particular, as described above. This insert module can, when introduced or inserted into the processing space, slide onto a suitable connecting element, with its at least one mating connection element, and thus be electrically contacted.

The insert module preferably comprises at least two mating connection elements so that it can easily supply at least one consumer of the insert module, e.g. a heating system, with power. The mating connection elements are preferably positioned symmetrically to one another on sides of the insert module that face away from one another.

In one embodiment, the at least one mating connection element has a sliding contact surface. The sliding contact surface, i.e. of an electrical contact surface, on which the contact pin of the connecting elements slides as far as an end position, enables particularly good cleaning to be achieved through dynamic friction.

In a further development, the at least one sliding contact surface adjoins an insertion slope by means of which, when the insert module is inserted, particularly if it is pushed in, the contact pins are pushed outward. This facilitates any insertion motion and further improves the self-cleaning of the contact surfaces.

In one development, in order to increase any cleaning effect for the contact pin, the insertion slope has at least one abrasive contact element, in particular a metal inlay.

The insert module can be, for example, a heatable cooking space divider, a heatable oven shelf or a heatable steam cooker, etc.

In a further development, the mating connection element, in particular the mating contact, is arranged on the insert module so as to be flush with it, which allows particular ease of cleaning and ease of handling and creates a high-quality appearance.

If the mating connection element, in particular the mating contact, is embodied as an inlay in a plastic tool, a preferred watertight connection can be achieved. As a result, the insert module can be embodied so as to be sink and dishwasher-proof.

Such a mating connection element is simple to integrate into the insert module.

BRIEF DESCRIPTION OF THE DRAWINGS

In the following figures, the invention is described in more detail by means of schematic representations of an exemplary embodiment. For reasons of clarity, elements that are the same or have the same effect are provided with identical reference signs.

DETAILED DESCRIPTION OF EXEMPLARY EMBODIMENTS OF THE PRESENT INVENTION

Figure 1:
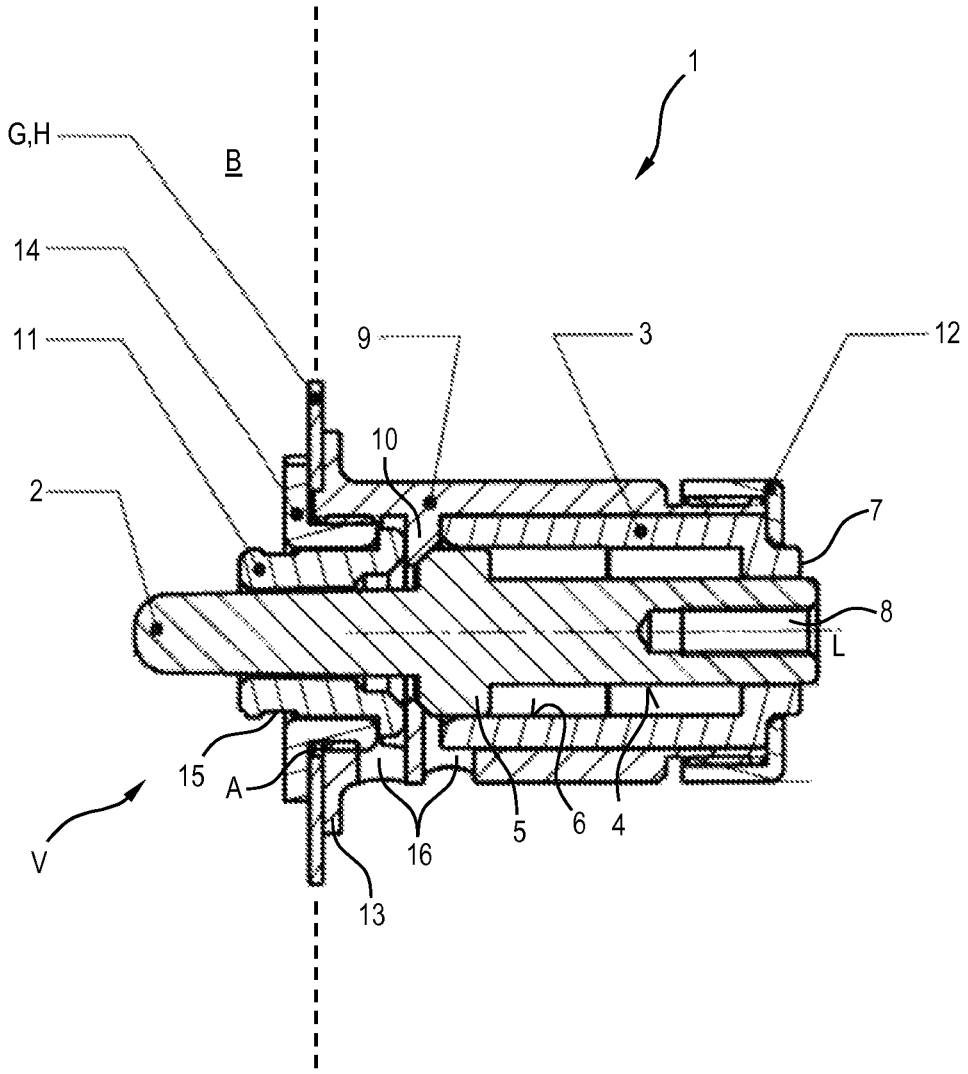
FIG. 1 shows a cross section of a side view of a connecting element according to the invention for a household appliance.

FIG. 1 shows a cross section of a side view of a connecting element 1 for a household appliance H. The connecting element 1 comprises, on a front side V, a protruding, longitudinally displaceable, electrically conductive contact pin 2 that can be displaced between a rest position protruding as shown and an operating position protruding less far (pushed in). The contact pin 2 is spring mounted and is pushed into the rest position by means of at least one spring element (not shown). The operating position can be variable and, for example, be dependent on a position of a mating contact element contacting the contact pin 2.

The rear section of the contact pin 2 is surrounded by a first electrically insulating insulation sleeve 3, in which the contact pin 2 can be carried along its longitudinal axis L. To this end, the contact pin 2 has an annular circumferential projection 5 on a sleeve or side wall 4 of its rear section, which is carried by an inner wall 6 of the first insulation sleeve 3. The first insulation sleeve 3 forms a stop for the contact pin 2 when it is moving in a rearward direction, said stop defining a farthest rearward position of the contact pin 2. At its rear end, the first insulation sleeve 3 has an opening 7 through which a rear end of the contact pin 2 can be passed. The rear end of the contact pin 2 comprises a connection possibility—here socket 8 with or without a thread, for connecting a power supply cable or similar (not shown).

An electrically conductive housing 9 delimits the first insulation sleeve 3 at its front end, said housing 9 also surrounding the sides of the first insulation sleeve 3. The housing 9 also has a sleeve or tube-shaped basic shape, as well as at least one inwardly protruding projection 10, said projection 10 also delimiting the first insulation sleeve 3 at the front and forming a forward stop for the contact pin 2 with its circumferential projection 5. The contact pin 2 is in the rest position when in contact with the projection 10.

The connecting element 1 also has a second electrically insulating insulation sleeve 11, which surrounds the contact pin 2 toward the front side V or toward the front in front of the projection 10, thus being arranged in front of the first insulation sleeve 3 in a longitudinal extension. The second insulation sleeve 11 is the component of the connecting element 1 from which the contact pin 2 protrudes forward into the open.

In order to assemble the connecting element 1, the first insulation sleeve 3, with the contact pin 2 inserted in it, may first be inserted into an open rear end of the housing 9 until the first insulation sleeve 3 comes into contact with the inwardly protruding projection 10 of the housing 9. Either before or after this, the second insulation sleeve can be inserted into an open front end of the housing 9 until the second insulation sleeve 11 comes into contact with an opposite side of the inwardly protruding projection 10 of the housing 9. The first insulation sleeve 3 can be secured with a suitable cover 12, e.g. a screw cap.

In order to mount the connecting element 1 on the household appliance H the by then assembled connecting element 1 is positioned at a rear side of the housing wall G in relation to a processing space B and, in the process, introduced into the processing space B with a part of the second insulation sleeve 11 and a front section of the contact pin 2, through a suitable cutout A in the housing wall G. The housing 9 is then located with a front edge, embodied as a flange 13, against the rear side of the housing wall G that faces away from the processing space B. The connecting element 1 is secured to the housing wall G by a securing disc 14 being inserted, from the side of the processing space B outward, into a wide annular gap between the housing 9 and the second insulation sleeve 11, thereby being bolted to the housing 9. The securing disc 14 thus pulls the housing 9 toward the housing wall G. At the same time, part of the second insulation sleeve 11 protrudes into processing space B via the securing disc 14.

Once the connecting element 1 is mounted, there is a depression or groove 15 around the outside of the second insulation sleeve 11 that is exposed to the processing space B in such a way that, in a longitudinal direction L, it is substantially immediately adjacent to the securing disc 14. This produces the advantage that fluid (e.g. water) that runs down the processing space side or inner housing wall G does not penetrate into the connecting element 1, or only does so to a slight degree. If, however, fluid does penetrate into the connecting element 1 it can flow out through two lateral openings 16 arranged on a lower side of the housing 9.

Also, once the connecting element 1 is mounted, the contact pin 2 when in its rest position is connected electrically to the normally grounded housing wall G via the housing 9 and is thus itself grounded.

In addition, the flange 13 of the housing 9 and the housing wall G, particularly a side wall, form a microwave-tight connection. As the diameter of the cutout A in the housing wall G does not measure more than 8 mm, it also cannot be penetrated by microwave radiation.

It is also possible for the contact pin 2 to be pushed all the way into the second insulation sleeve 11, for example during cleaning.

Figure 2:
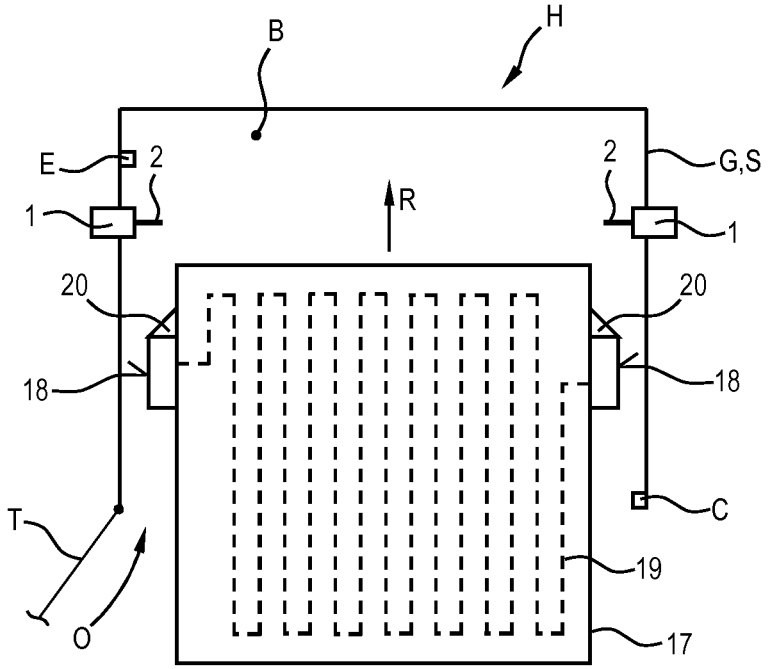
FIG. 2 shows a cross section from below of a household appliance with an insert module partially introduced into a processing space of the household appliance.

FIG. 2 shows a cross section from below of the household appliance H in the form of an oven, possibly with a microwave function, with an insert module 17 partially introduced into a cooking space or oven space serving as a processing space B through a loading opening O that can be closed by means of a door T. The insert module 17 here is embodied as an electrically heatable cooking space divider or shelf.

At one level, particularly an insertion level, the household appliance H comprises, by way of example, a connecting element 1 on each side wall S serving as a housing wall G, in a symmetrical arrangement. The household appliance H also comprises an insertion detection device E for detecting that an insert module 17 is fully inserted, said insert module not making contact in the partially inserted state shown. The household appliance H also comprises a door closure detection device C for detecting a closed state of the door T that closes the processing space B, which also cannot be seen here. The household appliance H is configured, e.g. through the appropriate programming of a control device (not shown) only to apply an electrical signal to the connecting element 1 if the insertion detection device E detects an insert and the door closure detection device C detects a closed state of the door T. For this reason the connecting elements 1 here cannot be activated when the insert module 17 is only partially inserted.

As a result of the connecting elements 1 being in a fully inserted state the insert module 17 has contactable mating connection elements 18 on both sides. The mating connection elements 18 are embodied as exposed contact surfaces extending longitudinally in the insertion direction R. The mating connection elements 18 are electrical connections of a consumer of the insert module 17, in this case a heating system 19. In order to facilitate insertion, an insertion slope 20 onto which the contact pin 2 of the associated connecting element 1 is able to slide up is located in front of each of the mating connection elements 18 in the insertion direction R. The mating connection element 18 is arranged on the insert module 17 so as to be flush with it, which allows particular ease of cleaning and ease of handling and creates a high-quality appearance. For more thorough cleaning of a contact surface of the contact pin 2 the insertion slope 20 comprises a metal strip. For improved ease of cleaning of the insert module, particularly in a sink or a dishwasher, it is advantageous for the metal strip and/or or the mating connection element 18 each to be embodied as an inlay set tightly in plastic.

Figure 3:
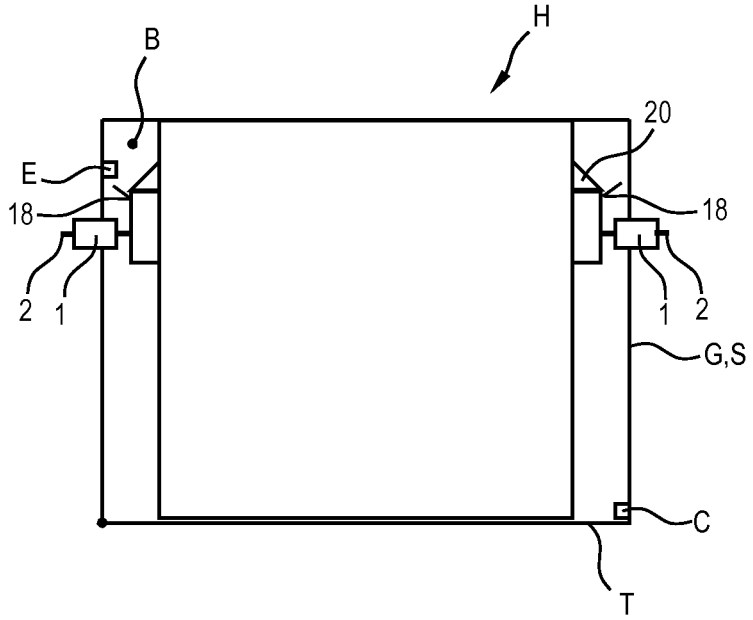
FIG. 3 shows a cross section from below of a household appliance with an insert module fully inserted into a processing space of the household appliance.

FIG. 3 shows the household appliance H viewed from below with an insert module 17 fully inserted into the processing space B and the door T closed. With the insertion of the insert module 17 the metallic contact pins 2 of the particular connecting element 1 have slid along the insertion slope 20 of the associated mating connection element 18 and been partially pushed out of the processing space B in the process. At the same time, the surfaces of the contact pins 2 have been rubbed clean against the metal strip of the insertion slope 20 (dynamic metal-metal friction). If pushed in still further, the contact pins also slide and rub against the exposed (laterally flush-mounted and sealed) contact surfaces of the mating connection elements 18, thus enabling clean and safe end contact.

The pressure force of the contact pins 2 is adjusted in such a way that both simple insertion of the insert module 17 and an optimal cleaning effect are achieved by the two connections 2, 18 sliding against one another.

When the insert module 17 is fully inserted and the door T is closed, both the insertion detection device E and the door closure detection device C make contact, with the result that the connecting elements can be activated, allowing current, for example, to be fed to the associated contact pins 2, which can operate the heating system 19 between them.

The present invention is, of course, not limited to the exemplary embodiment shown.

The power supply cable can therefore also be welded or bolted on, for example.

The invention claimed is:

1. A household appliance, comprising:

a first side wall defining a processing space; and a connecting element for providing an electrical connection in the processing space, said connecting element arranged on the first side wall and comprising a protruding, longitudinally displaceable contact pin that is displaceable between a rest position in which the contact pin protrudes farther from the first side wall into the processing space and an operating position in which the contact pin protrudes less far from the first side wall into the processing space, wherein the contact pin pushes into the rest position, the contact pin being electrically conductive, wherein the processing space is a cooking space.

2. The household appliance of claim 1, constructed in the form of a cooking appliance.

3. The household appliance of claim 1, wherein the connecting element has a first electrically insulating sleeve carrying the contact pin.

4. The household appliance of claim 1, wherein the first side wall includes an opening, and wherein the connecting element is at least partially disposed in the opening of the first side wall.

5. The household appliance of claim 4, further comprising:

a securing disc configured to secure the connecting element in the opening of the first side wall.

6. The household appliance of claim 1, wherein the protruding, longitudinally displaceable contact pin is displaceable in a direction perpendicular to the first side wall.

7. The household appliance of claim 1, further comprising a door for closing a loading opening of the processing space.

8. A household appliance, comprising:

a first side wall defining a processing space; and a connecting element for providing an electrical connection in the processing space, said connecting element arranged on the first side wall and comprising a protruding, longitudinally displaceable contact pin that is displaceable between a rest position in which the contact pin protrudes farther from the first side wall into the processing space and an operating position in which the contact pin protrudes less far from the first side wall into the processing space, wherein the contact pin pushes into the rest position, the contact pin being electrically conductive, wherein the connecting element has an inwardly protruding projection which forms a stop for the contact pin in the rest position, and wherein the processing space is a cooking space.

9. A household appliance, comprising:

a first side wall defining a processing space;

a door for accessing and closing a loading opening of the processing space; and a connecting element for providing an electrical connection in the processing space, said connecting element arranged on the first side wall and comprising a protruding, longitudinally displaceable contact pin that is displaceable between a rest position in which the contact pin protrudes farther from the first side wall into the processing space and an operating position in which the contact pin protrudes less far from the first side wall into the processing space, wherein the contact pin pushes into the rest position, the contact pin being electrically conductive, wherein the processing space is an interior space of a housing of the household appliance configured to receive an insert module that is inserted into the processing space through the loading opening of the processing space.

10. The household appliance of claim 9, further comprising:

a second side wall opposed to the first side wall, and a further connecting element on the second side wall symmetrical to the connecting element on an insertion level of the household appliance, wherein the further connecting element includes a further protruding, longitudinally displaceable contact pin that is displaceable between a rest position in which the further contact pin protrudes farther from the second side wall and an operating position in which the further contact pin protrudes less far from the second side wall, wherein the further contact pin pushes into the rest position, the further contact pin being electrically conductive.

11. The household appliance of claim 10, wherein the processing space is a cooking space.

12. The household appliance of claim 8, further comprising the insert module for insertion into the processing space, and an insertion detection device that detects when the insert module is fully inserted in the processing space.

13. The household appliance of claim 12, further comprising a door for closing the processing space, and a door closure detecting device that detects a closed state of the door, said household appliance only applying an electrical signal to the connecting element when the insertion detection device detects the presence of the insert module and the door closure detection device detects that the door has closed the processing space.

14. The household appliance of claim 12, wherein the insert module is at least one of a heating system, a heatable cooking space divider, a heatable oven shelf, or a heatable steam cooker.

15. The household appliance of claim 12, wherein the insertion detection device is at least one of a microswitch, a Reed contact, or an optical sensor.

16. The household appliance of claim 12, wherein the processing space is a cooking space.

17. The household appliance of claim 8, further comprising:

the insert module for positioning in the processing space of the household appliance, said insert module being configured for electrical operation and comprising a mating electrical connector that is electrically conductive and that contacts the contact pin of the connecting element to provide an electrical connection in the processing space of the household appliance.

18. The household appliance of claim 17, wherein the mating electrical connector has a sliding contact surface, wherein an insertion slope adjoins the sliding contact surface.

19. The household appliance of claim 18, wherein the insertion slope has an abrasive contact element.

20. The household appliance of claim 19, wherein the abrasive contact element comprises a metal inlay.

21. The household appliance of claim 17, wherein the insert module is at least one of a heating system, a heatable cooking space divider, a heatable oven shelf, or a heatable steam cooker.

22. The household appliance of claim 17, wherein the processing space is a cooking space.

23. The household appliance of claim 9, wherein the contact pin is electrically grounded to the first side wall when the contact pin is in the rest position.

24. A household appliance, comprising:

a first side wall defining a processing space; and a connecting element for providing an electrical connection in the processing space, said connecting element arranged on the first side wall and comprising a protruding, longitudinally displaceable contact pin that is displaceable between a rest position in which the contact pin protrudes farther from the first side wall and an operating position in which the contact pin protrudes less far from the first side wall, wherein the contact pin pushes into the rest position, the contact pin being electrically conductive, wherein the contact pin is electrically grounded to the first side wall when the contact pin is in the rest position.

25. The household appliance of claim 24, wherein the connecting element has a housing including an inwardly protruding projection which forms a stop for the contact pin, and wherein the contact pin contacts the inwardly protruding projection of the housing in the rest position such that the contact pin is electrically grounded to the first side wall by the housing when the contact pin is in the rest position.

26. The household appliance of claim 25, wherein the processing space is a cooking space.

27. The household appliance of claim 24, wherein the processing space is a cooking space.

28. A household appliance, comprising:

a first side wall defining a processing space;

a connecting element for providing an electrical connection in the processing space, said connecting element arranged on the first side wall and comprising a protruding, longitudinally displaceable contact pin that is displaceable between a rest position in which the contact pin protrudes farther from the first side wall and an operating position in which the contact pin protrudes less far from the first side wall, wherein the contact pin pushes into the rest position, the contact pin being electrically conductive; and a securing disc at least partially disposed in the processing space and securing the connecting element in an opening of the first side wall, wherein the connecting element includes a housing and the securing disc is coupled to the housing of the connecting element.

29. The household appliance of claim 28, wherein a portion of the contact pin extends through an opening in the securing disc.

30. The household appliance of claim 28, wherein the housing has a flange on a front edge facing the first side wall, the flange extending laterally outward to provide support for and contact with the first side wall and forming a microwave-tight connection with the first side wall.

31. The household appliance of claim 28, wherein the connecting element includes:

a first electrically insulating sleeve carrying a first portion of the contact pin, and a second electrically insulating sleeve surrounding a second portion of the contact pin and at least partially disposed in the opening of the first side wall.

32. The household appliance of claim 31, wherein at least a first portion of the securing disc is disposed on a side of the first side wall of the processing space, and at least a second portion of the securing disc is disposed in an annular gap between the housing and the second electrically insulating sleeve.

33. The household appliance of claim 31, wherein a portion of the second electrically insulating sleeve is exposed to the processing space and includes a depression or groove around an outside surface of the second electrically insulating sleeve that is substantially immediately adjacent to the securing disc for guiding fluid flowing down the first side wall.

34. The household appliance of claim 28, wherein the processing space is a cooking space.

35. A household appliance, comprising:

a first side wall defining a processing space; and a connecting element for providing an electrical connection in the processing space, said connecting element arranged on the first side wall and comprising a protruding, longitudinally displaceable contact pin that is displaceable between a rest position in which the contact pin protrudes farther from the first side wall and an operating position in which the contact pin protrudes less far from the first side wall, wherein the contact pin pushes into the rest position, the contact pin being electrically conductive;

wherein the connecting element has a housing having a lateral opening in a lower side of the housing for allowing fluid penetrating into the connecting element to flow out; and wherein the housing forms a microwave-tight connection with the first side wall.

36. A household appliance, comprising:

a first side wall defining a processing space;

a connecting element for providing an electrical connection in the processing space, said connecting element arranged on the first side wall and comprising a protruding, longitudinally displaceable contact pin that is displaceable between a rest position in which the contact pin protrudes farther from the first side wall and an operating position in which the contact pin protrudes less far from the first side wall, wherein the contact pin pushes into the rest position, the contact pin being electrically conductive; and a securing disc configured to secure the connecting element in an opening of the first side wall, wherein at least a portion of the securing disc is disposed on a side of the first side wall of the processing space, and wherein the securing disc is coupled to a housing of the connecting element;

wherein the housing of the connecting element has a lateral opening in a lower side of the housing for allowing fluid penetrating into the connecting element to flow out; and wherein at least a portion of the housing is disposed on an opposite side of the first side wall from the processing space.

* * * * *